United States Patent [19]

Ibanez

[11] Patent Number: 4,815,505

[45] Date of Patent: Mar. 28, 1989

[54] AUTOMATIC FILLING MACHINE FOR SIPHON BOTTLES

[75] Inventor: Alberto R. Ibañez, Buenos Aires, Argentina

[73] Assignee: Barbat & Co., Buenos Aires, Argentina

[21] Appl. No.: 947,658

[22] Filed: Dec. 30, 1986

[51] Int. Cl.[4] ..... B67C 3/08

[52] U.S. Cl. ..... 141/14; 141/16

[58] Field of Search ..... 141/1–17, 141/99, 100–110, 234–248

[56] References Cited

U.S. PATENT DOCUMENTS 1,162,741 12/1915 Benisch ..... 141/16

*Primary Examiner*—Mark J. Thronson

*Attorney, Agent, or Firm*—Kuhn and Muller

[57] ABSTRACT

An automatic filling machine for filling containers such as siphon bottles, carafes or the like with soda and/or carbon dioxide gas of the type in which said containers advance through a zone during which they are filled while the container is inverted bottom-to-top at an angle of up to about 180° in order to facilitate the return of gas under increasing pressure, including filling devices to which the containers are coupled during passage through the filling zone which permits in alternating sequences, the passage of soda and carbon dioxide gas to the containers, wherein the filling devices are directly coupled to two intermediate, independent and elongated reservoirs, extending along the filling zone, having individual selector controls intercalated between the filling devices and said reservoirs, only permitting the alternating passage of soda or gas to the container filling devices based on individual driver controls related to the advancing movement, including combinations of cams, offsets and the like with levers and rollers supported thereon.

15 Claims, 3 Drawing Sheets

AUTOMATIC FILLING MACHINE FOR SIPHON BOTTLES

FIELD OF THE INVENTION

The instant invention relates to continuous and automatic machines for filling containers such as carafes and the like with carbonated soda, carbon dioxide gas and with carbonated soda by previous dilution of gas in conventional saturators, said containers being provided with normally closed valve closures communicating with vent tubes axially extending through the interior to permit dispensing the liquid contained therein upon opening of said valve closures, said liquid passing from the vessels via vent tubes through which liquid is directed to the outlet, generally by means of special heads.

BACKGROUND OF THE INVENTION

Machines of the type known as rotary machines, are capable of filling containers, one after the other, in a generally continuous manner. Such machines are provided with means for turning said containers from a vertical position in which they bear on their bases to a position inverted almost 180° in which the open ends of the vent tubes are upwards, to allow the venting of carbon dioxide gas which builds up with increasing pressure in the upper part of the container during filling with the carbonated soda. Such gas being vented to the corresponding feeding means. Such machines include means for supplying soda into the same containers in sequences alternating with return and venting of gas, said soda and gas circulations being carried out at pressures higher than atmospheric.

Known automatic and rotary filling machines, generally have individual supports for containers, on which said containers are conveyed around a central fixed cylindrical body in a concentric arc of almost 360°. As the containers are advanced, the supports begin carrying their respective containers in a vertical upright position bearing on their bases and, immediately, invert them end-over-end almost 180°, to make the major portion of each path of travel in such inverted position, which is the required filling position, and then terminating the advance with an inverting movement whereby the containers are returned to the original vertical position, bearing on their bases.

During the indicated circumferential travel of almost 360°, the filling process involves alternating sequences of soda inlet and carbon dioxide gas return or outlet (carbon dioxide gas displaced by said soda). The process begins with a gas feed and then the alternated sequences take place.

The raising and inverting operations are produced by means of combinations of cams, offsets or guides at variable levels, on which rollers are supported, one per container support; said offsets or the like being mounted to said central body, which is fixed.

In such known machines, to obtain the precise alternating sequences of feeding of soda and gas required, complex and expensive combinations of components and devices are included which also require extensive servicing due to the precision of the operation and the continuous wear of the parts involved.

On the other hand, it is convenient that the containers filled by such machines be of the type comprising vessels, bottles or carafes which, apart from the indicated vent tubes, have heads with ejecting nozzles, a lever for actuating the normally closed inner valve communicating with its vent tube, and the corresponding means for supporting said vent tube.

Dispensing nozzles of said heads are partially sloping to provide free falling of possible leaks and to direct the liquid dispensed towards glasses or the like receiving the soda. This sloping configuration of the dispensing nozzles corresponds to the magnitude of almost 180° of the inverting movement, in order that said nozzles be vertically disposed when inverted and be upwardly directed in order to face corresponding vertical filling means through which soda and gas pass to each container, in accordance with the filling sequences.

Apart from the indicated elements for inverting movement and fluid supply in alternating sequences, an electric drive motor for circumferentially advancing the container supports, inverting and raising the containers and corresponding sources and means for supplying said fluids, known machines are provided with means protecting against bursting of the containers charged with pressurized fluids; with operative means for actuating the levers of the heads in order to open the passage to and from vent tubes simultaneously to the inverting movements; operative means for safety in the event of partial or total shutdown of the equipment when accidents or blockages take place during operation. Preferably, also provided are continuous conveying means for empty containers, such as horizontal chains provided with links having coplanar flat plates; transfer devices for shifting, one in turn, containers on such horizontal conveyors towards supports receiving such containers on the filling machine; and similar devices for final transfer of filled containers from the filling machine to transport means for their distribution.

Although machines of the prior art have been successfully used commercially, it is to be noted that elements and means included for supplying soda and gas in alternating sequences to vertical filling means, apart from being complex and expensive, require frequent shut down of operations for maintenance and replacement of parts, which fact severely affects production. For these reasons, improvements have been carried out, and also modifications and changes in operating conditions in the light of the instant invention, which relates to machines concerning fluid (soda and carbon dioxide) supply in accordance with sequences easy to program and which may be subject to further adjustments, as explained hereinbelow.

SUMMARY OF THE INVENTION

An object of the instant invention comprises providing a continuous filling machine of the rotary operating type for containers such as carafes, bottles and the like, wherein said containers are filled with soda and carbon dioxide gas, wherein during the filling operation, the containers having a path of travel as per a circumferential arc of almost 360°, said containers being inverted end-for-end at an angle of less than 180° in order that the open ends of the container vent tubes are directed upwards while said containers travel along said filling portion, said filling machine including means for feeding vertical filling elements to which said containers are coupled during said travel, and means sequentially allowing alternating passage of soda and carbon gas to said filling vertical elements, having the novel feature that said vertical filling elements are coupled directly to the elongated and intermediate reservoirs extending along said travel, having individual selectors therebetween which only allow alternating passage of soda and gas towards the filling elements by individual driving thereof through command means related with the advance movement, such as combinations of offset cams, variable level guides, stops, etc., with levers and rollers supported thereon, or the like; said reservoirs being directly connected to corresponding feeding sources.

The rotary machine of the instant invention includes the basic novelty of having direct connection means to vertical filling elements from conventional sources, such as cylinders or carafes of carbon dioxide gas as well as conventional machines for preparing carbonated soda, such as saturators and the like.

From said connecting means, this novel machine directly feeds the vertical filling elements which advance, in cooperation with each inverting support; with the novel introduction of intermediate containers or reservoirs of soda and gas, under such conditions that the expensive elements and parts heretofore required are eliminated, with the additional inclusion of simple mechanical selectors permitting passage of these fluids alternatively to or from said vertical filling elements.

The simple selectors are similar to hydraulic cocks which, by means of predetermined rotation, of from about 90° to 180°, allow selective intercommunication of a channel with one or other similar channels of an inlet or outlet pair. Conventional means for alternate driving of the selectors may comprise combinations of rollers supported by variable level guides, offset cams similar to that used in the past for effecting the lifting and inverting movements, or fixed stops connected to rollers or cranks connected to the rotors of the selectors, etc.

The duration of said soda feeding and corresponding alternating partial gas returns or releases, in the various operative sequences, depend on the time said means remain open or closed, or connected by the action of selectors, so that complete filling operations are carried out automatically.

Therefore, in accordance with the instant invention, complex and expensive conventional devices for selecting and programming filling and release sequences are avoided, being replaced by simple elongated intermediate reservoirs extending along the filling path of travel directly fed from respective conventional supply sources, and individually and directly communicating with vertical filling elements. Corresponding passage selectors are commanded in accordance with alternating sequences by means of conventional mechanical means, such as those used for producing raising and inverting movement of the containers being filled; said intermediate reservoirs are provided in pairs, one for carbon dioxide gas and the other for soda.

Several embodiments are contemplated within the scope of the instant invention affecting, for example, the constitution of intermediate reservoirs, as well as of the passage selector elements for vertical filling elements, and their operation.

A convenient and preferred embodiment of said elongated reservoirs is that in which they are simultaneously constituted by a single sealed annular container divided into two parts by means of a longitudinal separating divider, which is also annular. In this case, the two compartments at both sides of the division are fed by respective pipes, said pipes coming from conventional sources of soda and carbon dioxide gas. Said divider may be horizontal or vertical; in the first case, the reservoirs are located one in the upper part and one in the lower part, instead of being located at both sides of the divider. In any of these alternatives, selectors and filling elements will be separately and directly connected to each of said compartments.

Since rotary filling machines of the type used in accordance with the invention have fixed and rotating parts supported in general by fixed parts, the machine of the invention includes among said rotating parts the mentioned intermediate containers, interconnected to vertical filling elements and also to selector means.

On the other hand, means controlling the driving of said selectors are preferably supported by accessory parts which, in turn, are joined to fixed parts of the machine.

BRIEF DESCRIPTION OF THE DRAWINGS

In order to describe the indicated advantages to which those skilled in the art may add many others, and to facilitate the understanding of the constructive, constitutive and functional characteristics of the machine of the invention, a preferred embodiment will be described hereinbelow, which is schematically shown, in the attached drawings. Since this embodiment constitutes an example, it is not to be considered as limiting the scope of protection of the instant invention, but only illustrating or explaining the basic concept thereof.

FIGS. 9 (A–D) are cross-sectional views showing four alternative embodiments in which the divider for the intermediate reservoir is horizontal instead of vertical, as in previous figures.

FIGS. 10 (A–C) are cross-sectional views showing three schemes of an embodiment of FIG. 9 wherein the selector of fluids to be transferred is actuated directly in accordance with raising positions of the receiving container.

In all figures the same reference numerals correspond to the same or equivalent parts or constituting elements of the embodiments selected as examples of the instant invention.

DETAILED DESCRIPTION OF THE INVENTION

Figures 1, 2, 3A, 3B:
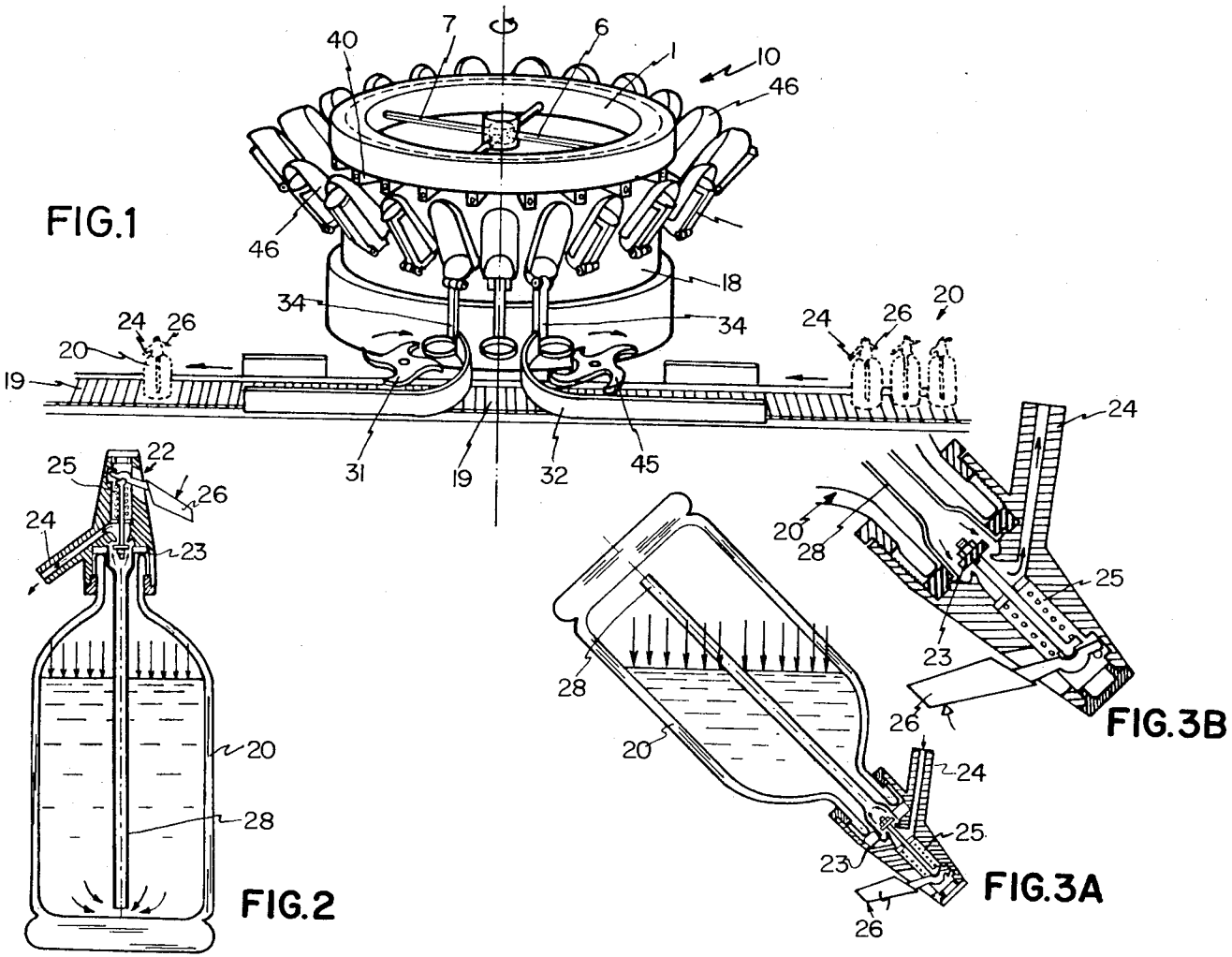
FIG. 1 is a perspective view in which a rotary and automatic machine of the invention is shown for continuous filling of carafes with soda, wherein said carafes have heads and accessories, with their vent tubes vertical and open ends downwards.
FIG. 2 is a vertical cross-section of one of the containers which may be filled with the machine of FIG. 1; and in which the container is shown dispensing its contents.
FIG. 3A is a cross-section of a container shown in FIG. 2, in which the container is in an inverted position, corresponding to the filling position, at which time the inner valve is also opened.
FIG. 3B is an enlarged cross-section of the inner valve of the container shown in FIG. 3A.

As may be seen in FIG. 1, the machine 10 selected as an example for this specification, is of the type comprising a lower cylindrical body 18 which is fixed and located at a side of a horizontal conveying chain 19, preferably having flat plate links of a conventional type 19', which advances and withdraws soda containers 20 provided with heads 22 having an ejection nozzle 24 and a lever 26 which activates an inner valve contained in said heads 22, as is conventional in the art.

A first transfer element 30, or deflector which is also known and consists of a rotatable star 31 combined with an arcuate side guide 32, delivers containers 20 from conveyor 19 to swiveling support 34 which, at the said delivery point is in a vertical position as shown at 35. An offset guide 36 secured to lower body 18 (shown in FIG. 4), biases rollers 38 supported on the swivelling support assembly 34 as they are advanced about lower body 18, causing a raising and inverting movement of almost 180° which may be also seen in FIG. 4, and which in this aspect coincides with FIG. 3 in which containers are in their inverted filling position. In such position, each nozzle 24 is vertically located in alignment with filling valve 40.

During a path of a travel of less than 360° about the cylindrical body 18, a variable level continuous cam 42 drives the manual lever 26 of the head 22 of the container 20 (FIG. 4), in which cam the swivelling roller 44 is supported to open passage through inner valve 23, opposite to spring 25, shown in FIGS. 2, 3A and 3B. This detail, has been depicted in a larger scale in FIG. 3B, in which may also be seen the coupling of the vent tube 28 contained in said containers 20. During such path of travel, containers 20 are being filled.

Upon travelling the whole arc of almost 360°, swivelling supports 34 return to vertical position 35, and the filling containers are removed by means of the second transfer means 45 towards a distribution zone or the like, such as packaging arrangements, etc.

With reference 46, protective elements are indicated, against possible bursting of containers filled with soda and gas at a pressure higher than atmospheric, and which are attached to supports 34 during their travel.

In the above description, generally conventional aspects of the filling machine have been described, and novel aspects of the filling machine of the invention will be described below in detail.

Figures 4, 5:
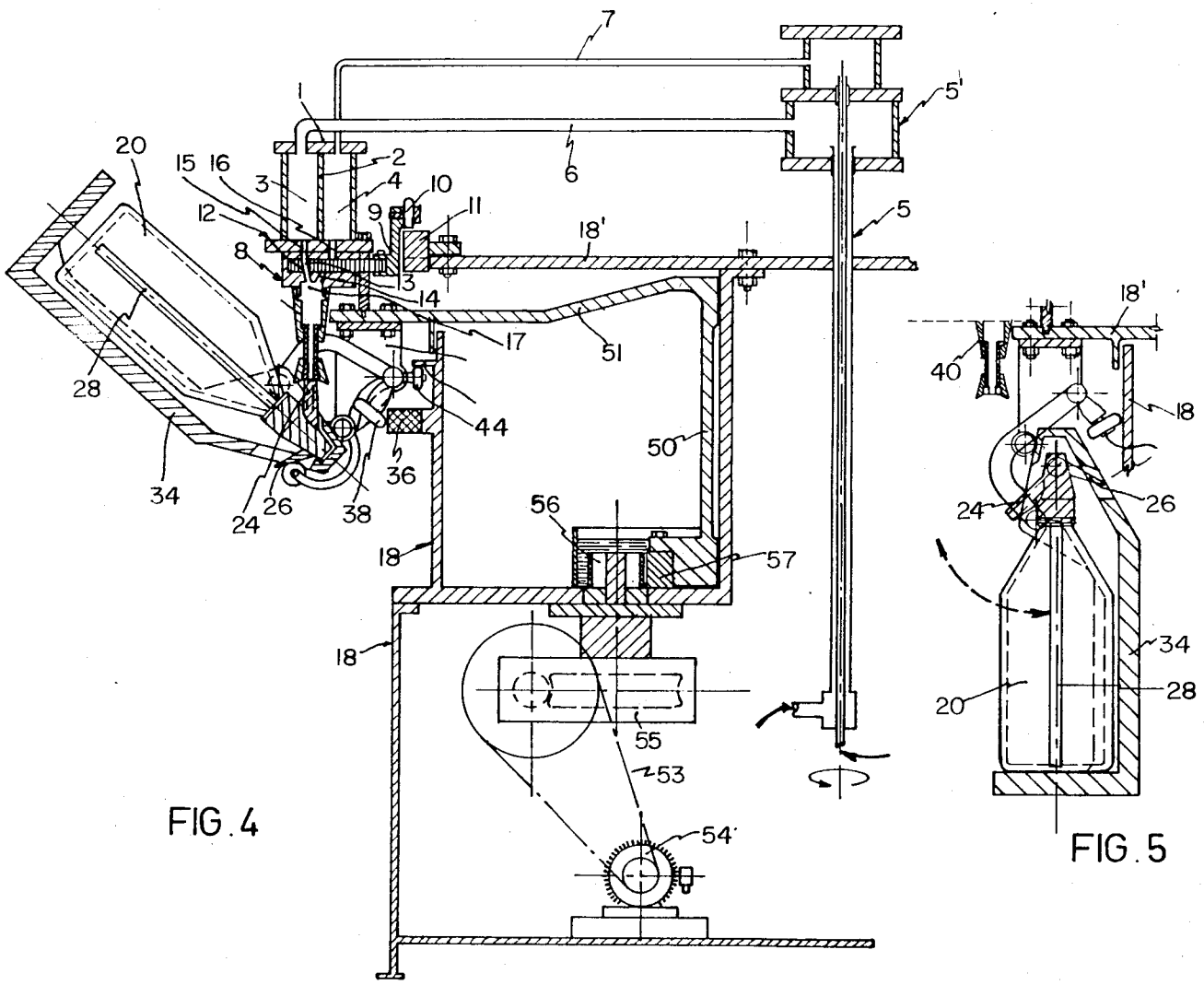
FIG. 4 is an enlarged cross-sectional view of a portion of the machine of FIG. 1.
FIG. 5 is an enlarged cross-sectional view in which the machine supports the container to be filled, with the container bearing on its base being held by one of the raising and inverting supports of the machine shown in FIG. 1.

Referring to FIGS. 1 and 4, a basic aspect of the invention is the addition of an intermediate elongated container 1, accompanying swivelling supports 34 in their path of travel around the fixed cylindrical body 18. Said elongated container 1 is also annular and is divided into two independent reservoirs by means of an internal divider 2, as shown in FIG. 4 with references 3 and 4. Such divider 2 may be vertical, such as shown in FIG. 4, or horizontal as shown in FIGS. 9 and 10.

One of said intermediate reservoirs, such as 3, is fed with carbon dioxide gas at a pressure higher than atmospheric, while the other reservoir 4 receives soda conventionally and separately prepared, at a pressure even higher than that of the gas. In the example shown, both intermediate and elongated reservoirs 3 and 4 are fed by means of a central hollow column 5 through horizontal branches 6 and 7 of any suitable type and independent of each other. Branch 6 is fed directly through the external channel forming the column and branch 7 is fed by the inner and coaxial conduit. Communication between the column and the branches may be carried out with the conventional intercalation of rotary tanks 5', having known interconnectors. The supply of soda and gas to said vertical hollow column 5 may be carried out from the bottoms thereof as indicated by the arrows.

Another aspect of the invention is that conventional filling valves 40 are directly fixed under the reservoirs 3 and 4 into which the intermediate container 1 is divided, in this case with selector means 8 for said fluids, gas and soda, in order that transfer between said reservoirs and the container to be filled be made alternatively, under programmed sequences.

Said transfer actions are carried out in accordance with the following steps: first, reservoir 3 is communicated with the container 20 to be filled in order that it may be filled with carbon dioxide gas at a pressure higher than atmospheric; then said communication is closed, and communication to the soda is opened between reservoir 4 and the container 20 at a pressure higher than that of the gas, in which case, the gas is compressed and increases in pressure. Then gas reservoir 3 is again connected with the container and, since the gas pressure in the container has increased to a value higher than that existing in said reservoir 3, a return or release of gas is carried out; then soda enters again, and so on, until the surface of soda level reaches approximately the same height of the free end of the vent tube 28 of the container 20, in the filling position, said filling operation thus being completed.

Figures 6, 7, 8, 9A, 9B, 9C, 9D, 10A, 10B, 10C:
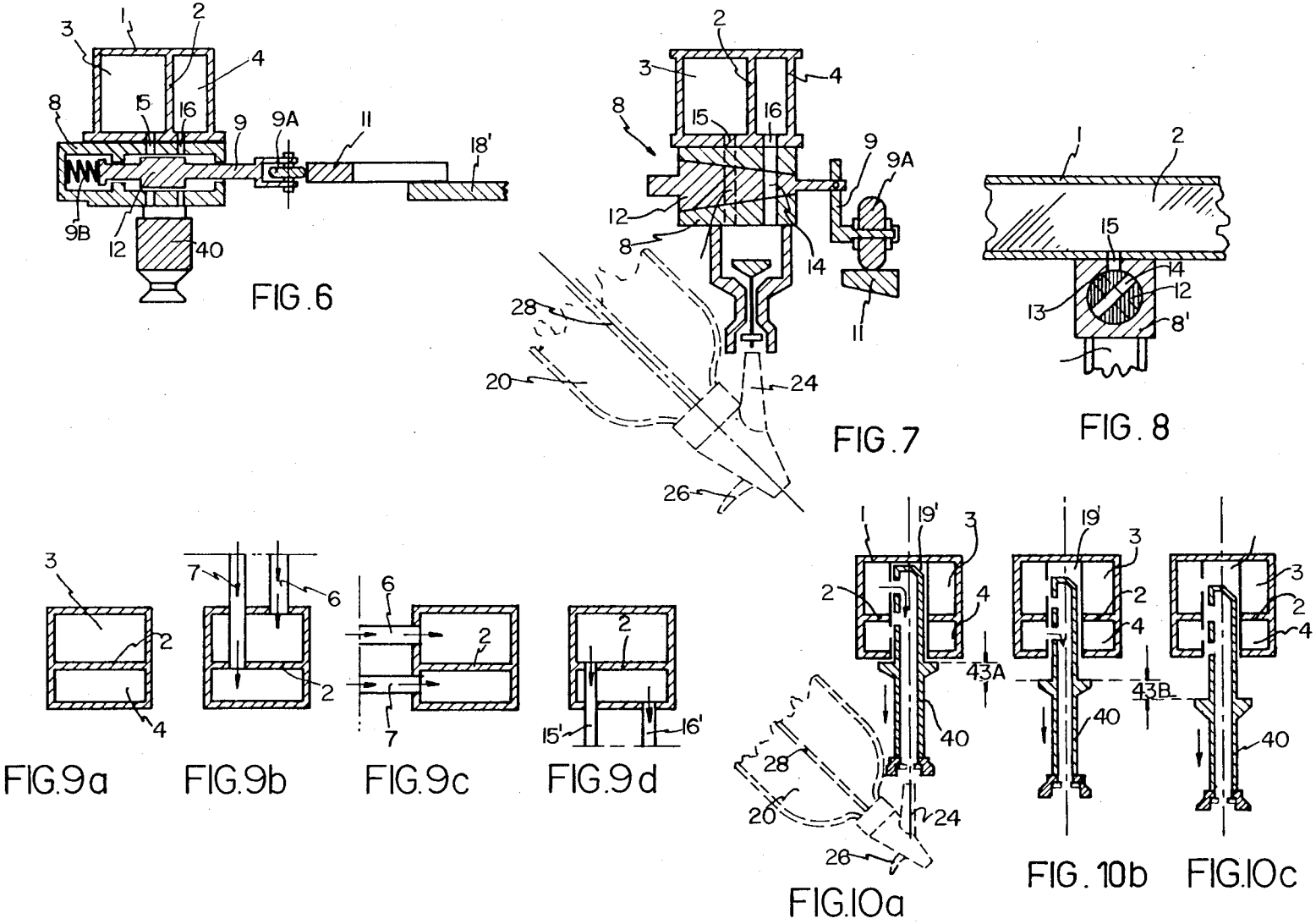
FIG. 6 is a cross-section view which shows an alternative embodiment of the selectors and filling elements, in accordance with the invention.
FIG. 7 is a cross-section view, part in phantom of another operative alternative embodiment of the selector and filling elements in accordance with the invention.
FIG. 8 is a perpendicular cross-section view of the selector and filling elements shown in FIG. 7.

In the embodiment shown in FIGS. 4 and 6, each selector 8 is illustrated comprising a cylindrical, horizontal stem 12, rotary around its axis, provided with two traverse and oblique orifices 13 and 14 which may be selectively aligned with orifices communicating with the bottom of each of the reservoirs 3 and 4. A lever arm 9 secured to the stem 12 has at its end a rotary roller 9A which bears on an upper and variable level cam 11. Different heights of the cam 11 cause rotation of stem 12.

Further, said stem 12 rotating in the interior of selector 8, has its traverse orifices intercalated between corresponding ports 15 and 16, internal, of said body 8, which are oblique and extend from reservoirs 3 and 4, as shown in FIGS. 4, 6, 7 and 8, to the interior of filling valve 40.

The assembly formed by reservoirs 3 and 4, selectors 8, filling valves 40, swivel supports 34 and rollers 38 and 42 rotates around the fixed body 18, preferably taking advantage of the cams and guides of conventional filling machines above described. Therefore, the upper flat plate 18' of the stationary body 18 supports variable level cam 11, also stationary, while the rotating portion of the machine 50 is used to concentrically rotate said elements 3, 4, 8, 40, 34, 38 and 44 around the lower cylindrical body 18, using to this end the intermediate rotating flat plate 51 which at its circumferential edge holds supports 52 carrying the containers along their circumferential path of travel, along with the inverting elements, etc.

Rotation of said body 50, which is also known in machines of this kind, may be carried out by means of the lower electrical motor drive 54, a belt or chain drive 53, a speed reducer 55 and a known transmission of pinion and crown in oil bath 56 and 57 which is secured to the inner cylindrical wall 50 of the machine.

The optional alternative embodiment shown in FIG. 6 uses an offset, instead of a variable level cam 11, with variable flange with respect to the stationary part 19' of the machine, in order that roller 9A will bear laterally on cam 11 and, by means of an opposing spring 9B, effect longitudinal displacement in the interior of selector 8 of a piston 12, leaving free passage through holes 15 or 16.

In the embodiment of FIG. 7, rotary body 12 of selector 8 is tapered. In this Figure, a diagram of the inner valve element of filling valve 40 of a conventional type may be also seen.

FIG. 8 shows diametral directions of the holes passing through rotor 12 of the selector 8, in accordance with the embodiment shown in FIG. 7.

Referring now to FIGS. 9 and 10, alternative schemes are depicted in which the elongated intermediate reservoirs 3 and 4 are separated by a horizontal divider 2, as shown in schemes A to D of FIG. 9. The supply of gas and soda is provided to the filling machines as shown in FIG. 4, directly through vertical or horizontal conduits 6 and 7 shown in schemes B and C of said FIG. 9. Short outlet conduits 15' and 16' shown in Scheme D are equivalent to ports 15 and 16 of previous examples.

Sequential operation in the case of separated horizontal reservoirs 3, 4, may be carried out in accordance with the invention using similar or the like elements to that of the previous examples. Horizontal intermediate divider 2 allows the use of filling elements which, in turn, act as selectors, since they function based on inverted displacement of the receiving containers 20 with its ejector nozzle 24 directed upwards, as shown in schemes E, F, and G of FIG. 10. Scheme E corresponds to a position of free transfer of gas contained in the reservoir 3 to the container 20 through its ejector nozzle 24; scheme F shows soda transfer to the same container from reservoir 4, while in scheme G, the closed position for both reservoirs is shown.

Filling valve 40 of this vertical displacement alternative, may be selectively controlled by a variable level guide or the like used in rotary machines of this kind, vertically moving in the vertical conduit 41, which is preferably cylindrical and passes through both reservoirs 3 and 4 in its central zone or other convenient region, there being corresponding holes in said conduit in order that soda or gas may pass to the valve. References 43A and 43B indicate relative vertical displacements carried out by each container 20, along with valve 40.

When carrying out the rotary filling machine of the invention, modifications and/or improvements may be introduced, all of which are to be considered within the scope of the invention, which is only limited by the spirit of the appended claims.

What is claimed is:

1. Continuous filling machine for filling containers such as siphon bottles, carafes and the like with soda and carbon dioxide gas, of the type in which said containers continuously advance through a filling zone in which they are inverted bottom-to-top at an angle up to about 180° in order that the free ends of vent tubes within said containers are directed upwards while said containers travel through said filling zone, comprising: filling valve means to which containers are connected during travel through said filling zone; and means permitting alternating passage of successive supplies of soda and carbon dioxide gas to said containers,wherein said filling valve means are directly coupled to two elongated and independent reservoirs intermediate said filling valve means and soda and carbon dioxide feed means, one adapted for containing gas at a pressure higher than atmospheric and the other adapted for containing soda at a pressure higher than that of the gas, having selector control means for fluids which only allow alternating passage of gas and soda to said valve means based on the individual driving thereof by means disposed along a path of travel of said containers which includes combinations of cams, offsets and the like with levers and rollers bearing thereon.

2. The continuous filling machine as claimed in claim 1, wherein the two intermediate and elongated reservoirs extend substantially to about the same extent as the filling zone for containers.

3. Continuous filling machine as claimed in claim 1, wherein the two intermediate and elongated reservoirs are formed by a sealed container being divided longitudinally along the length thereof, each reservoir communicating with independent sources of carbon dioxide gas or soda.

4. Continuous filling machine as claimed in claim 1, wherein each fluid selector means is a cock with two internal passages.

5. Continuous filling machine as claimed in claim 1, wherein each fluid selector means is an axial displacement valve provided with two independent channels.

6. Continuous filling machine as claimed in claim 1, wherein each fluid selector means is a vertical displacement valve provided with a single axial channel and two side connecting ports located at different levels.

7. Continuous filling machine as claimed in claim 3, wherein each fluid selector means is an axial displacement valve provided with two independent channels.

8. Continuous filling machine for filling containers such as siphon bottles, carafes and the like with soda and carbon dioxide gas comprising:

(a) means for continuously advancing a container to be filled circumferentially about a cylindrical support means;

(b) means for inverting said containers to be filled at an angle up to about 180° in order that the free ends of vent tubes within said containers are directed upwards in the container during travel through a filling zone substantially coextensive with a path of travel about said cylindrical support means;

(c) two independent reservoirs disposed intermediate carbon dioxide gas and soda feed means and filling valve means for said containers in substantial alignment with the circumferential path of travel of said containers in said filling zone adapted to separately contain carbon dioxide gas at a pressure higher than atmospheric pressure and soda at pressure higher than that of said gas;

(d) filling valve means directly connected to said containers to be filled and said independent reservoirs; and (e) selector control means for fluids which only allow alternating passage of gas and soda between said filling valve means and said reservoirs.

9. A continuous filling machine as claimed in claim 8, wherein said two reservoirs are formed by a sealed annular container divided into two parts by a divider longitudinally extending the length thereof, each part being sealed from the other.

10. A continuous filling machine as claimed in claim 8, wherein each reservoir is independently in communication with supply sources of carbon dioxide gas or soda.

11. A continuous filling machine as claimed in claim 10, wherein each selector means is an axial displacement valve provided with two independent channels.

12. A continuous filling machine as claimed in claim 8, wherein said selector control means are mechanically activated.

13. A continuous filling maching as claimed in claim 12, wherein said control means are automatically carried out.

14. A continuous filling machine as claimed in claim 8, wherein said machine comprises: means for automatically inverting a filling container on said machine to an upright disposition; means for automatically transfering a filled container from said machine to a conveyor means; and conveyor means for continuously advancing filled containers from said machine.

15. A continuous filling machine as claimed in claim 8, wherein said filling valve means includes a filling valve in vertical alignment with a nozzle on a container to be filled when said container is in the inverted disposition, said container nozzle being vertically disposed and extending upwardly.

* * * * *